US008397779B2

(12) United States Patent
Bray et al.

(10) Patent No.: US 8,397,779 B2
(45) Date of Patent: Mar. 19, 2013

(54) ROD WRAPPERS

(75) Inventors: Andrew Jonathan Bray, Southampton (GB); William David Lewis, Southampton (GB); Steven Holford, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 938 days.

(21) Appl. No.: 10/554,777

(22) PCT Filed: Apr. 29, 2004

(86) PCT No.: PCT/GB2004/001833

§ 371 (c)(1),
(2), (4) Date: Oct. 27, 2006

(87) PCT Pub. No.: WO2004/095957

PCT Pub. Date: Nov. 11, 2004

(65) Prior Publication Data

US 2007/0056598 A1 Mar. 15, 2007

(30) Foreign Application Priority Data

Apr. 30, 2003 (GB) ..... 0310034.4

(51) Int. Cl.
*B32B 41/00* (2006.01)

(52) U.S. Cl. ..... 156/349; 156/64; 156/350; 156/353; 156/356; 156/357; 156/360; 156/361; 156/362; 156/363; 156/364; 156/366; 156/367; 156/378; 156/379; 131/58; 131/62; 131/64.1; 131/66.1; 131/69; 131/355; 131/358; 131/365; 131/371

(58) Field of Classification Search ..... 156/64, 156/350, 353, 356, 357, 360, 361, 362, 363, 156/364, 366, 367, 378, 379; 131/58, 62, 131/64.1, 66.1, 69, 355, 358, 365, 371
See application file for complete search history.

(56) References Cited

U.S. PATENT DOCUMENTS

| | | | | |
|---|---|---|---|---|
| 4,237,907 | A | 12/1980 | Pawelko et al. | |
| 4,481,067 | A * | 11/1984 | Off et al. | 156/541 |
| 4,541,826 | A | 9/1985 | Warner | |
| 5,221,350 | A | 6/1993 | Tallier et al. | |
| 5,450,863 | A | 9/1995 | Collins et al. | |
| 5,531,233 | A * | 7/1996 | Oglesby et al. | 131/69 |
| 5,915,625 | A | 6/1999 | Focke et al. | |
| 6,904,917 | B2 * | 6/2005 | Kitao et al. | 131/65 |

FOREIGN PATENT DOCUMENTS

| | | |
|---|---|---|
| DE | 10150272 | 4/2003 |
| GB | 2261152 A | 5/1993 |
| WO | 9740715 | 11/1997 |
| WO | WO 0219848 A1 * | 3/2002 |

* cited by examiner

*Primary Examiner* — Katarzyna Wyrozebski Lee
*Assistant Examiner* — Joshel Rivera
(74) *Attorney, Agent, or Firm* — Middleton Reutlinger; Charles I. Sherman

(57) ABSTRACT

This invention relates to a material application system for applying material to a wrapper. The material application system comprises a material applicator means and an electronic application control means. Also provided is a rod making machine comprising a rod making section and the material application system. The invention also provides a method of applying material to a wrapper used in the tobacco industry comprising supplying a wrapper and applying a material to the wrapper using a material applicator and an electronic applicator control means therefore, which electronic applicator control means ensures accurate location of material application in an electronically adjustable variable manner.

49 Claims, 2 Drawing Sheets

ROD WRAPPERS

CROSS REFERENCE TO PRIOR APPLICATION

Figure 1:
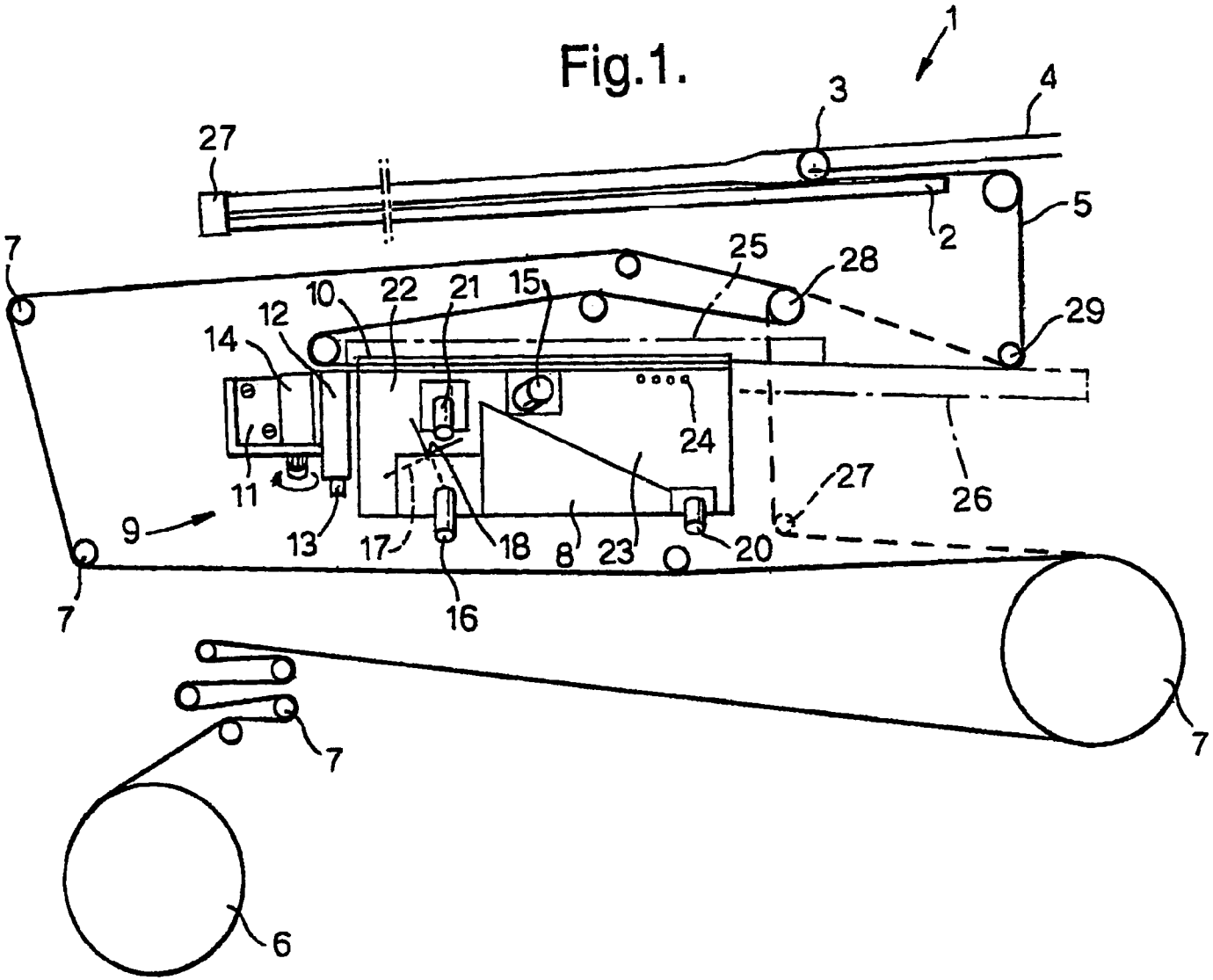

This application is a national stage filing (35 U.S.C. 371) of PCT/GB2004/001833, filed on Apr. 29, 2004, which claims priority to and benefit from Great Britain Patent Application No. 0310034.4, filed on Apr. 30, 2003, currently pending.

This invention relates to material application to rod wrappers, particularly but not exclusively, to rods manufactured in the tobacco industry and wrappers used therein.

In the tobacco industry a number of different continuous rods or rod lengths are manufactured, examples of these being filter rods or tobacco rods. Each rod comprises rod materials and a wrapper. In the case of filter rods the rod material is filtration material. In the case of tobacco rods the rod material is tobacco or some other smoling material. The wrapper for filter rods is usually plugwrap, but may be tipping wrapper if the filter rod is self-sustaining. The wrapper for tobacco rods is cigarette paper.

Over the years it has become desirable to apply materials to any of the wrappers of such rods. In the case of filter rods British Patent Specification Nos. GB 2 249 936 and GB2261152 disclose the application of granular material to plugwrap to produce a filter known as the "Active Patch Filter" or APF filter. These patents describe the product but only briefly mention how the product can be produced. Both patents describe coating the wrapper with adhesive using a printing wheel, for example, and then coating with particulate material by passing the wrapper through a reservoir, a fluidised bed or circulated stream of the particulate material.

In the case of tobacco rods the production of cigarette papers with zones of burn rate altering material applied thereto has become of interest with respect to low ignition propensity cigarettes. U.S. Pat. No. 5,450,863 describes applying regions of adhesive to a cigarette paper by using adhesive rollers, then dusting the coated wrapper with a burn rate altering powder. This apparatus, though, is limited to applying only particulate material to the cigarette paper.

In addition, within the tobacco industry it is desirable to achieve high speed application of material, such as adhesive; for example, to a wrapper in a manner which suits the high speed rod making requirements of the industry. Currently wrapper application techniques are conventionally achieved using roller transfer techniques which can operate at these high speeds. These systems consist of a roller that rotates within a bath of flowable medium, e.g. adhesive. The roller picks up and transfers the flowable medium either directly, or indirectly via an intermediary delivery roller, to the wrapper. Whether a direct or indirect system is used a modified roller surface is required, such as a "pocketed" surface, usually along with a method to remove excess adhesive from the surface of the roller around the pockets, so that clean well-defined patches of material are produced on the wrapper. This type of mechanical application is described in U.S. Pat. No. 5,450,863.

A disadvantage of these types of mechanical system of roller application is the physical size of the rollers, size being important for robustness, especially in view of the high pressures required between the rollers of multiple roller systems. High pressure is required to create a cleanly defined patch, as the pressure drives adhesive from the roller surface, leaving only adhesive within the "pocket" of the roller.

A further disadvantage of the mechanical system is associated with the registration of the rollers to a machine timing mark to ensure the material application is correctly and consistently positioned on the wrapper relative to a predetermined point. To enable this functionality, sophisticated and bulky drive systems are required. In addition, new rollers need to be manufactured to enable production of different style products, for example, (i) longer or shorter adhesive patches, for example, require a change to the pocket length, (ii) longer or shorter rod lengths require a change in roller diameter, and (iii) greater or lesser amounts of adhesive, for example, requires a change in "pocket" depth of each roller. The time consuming nature of machine down-time and cost of that down-time, as well as the cost of new rollers, etc. means that conventional roller systems do not offer flexibility at low cost.

Furthermore, these systems are bulky and their physical size dictates the requirement for a major machinery development exercise, as the roller unit is so large it does not fit within the available free space of existing machinery.

It is an object of the invention to provide a rod making machine of the tobacco industry with a compact material application system.

It is a further object of the invention to provide a rod making machine of the tobacco industry with a compact application system, which may be retrofitable to existing machinery, thereby being of low cost compared to a full machinery development.

It is a further object to provide an electronically controlled system with improved flexibility and accuracy of material application.

The present invention provides a rod making machine comprising a rod making section and a material application system, the material application system comprising material applicator means and electronic application control means.

The present invention further provides an off-line wrapper material application system, the material application system comprising first wrapper supply means, wrapper storage means, material applicator means and electronic application control means.

Preferably the material applicator means is an electronically controlled applicator means.

Preferably the rod making machine is a machine of the tobacco industry. Advantageously the rod making machine is a tobacco rod making machine or a filter rod making machine. The rod making machine may also be a machine for combining rod sections, such as a filter rod combining machine.

Such rod making machines comprise rod material supply means and a wrapper supply means. Preferably the rod making section of the rod making machine receives either cigarette paper or filter wrapping material, such as plugwrap or tipping paper.

Preferably the material applicator means is a flowable medium applicator, and is most preferably an applicator gun. Advantageously the applicator gun is adjustably mounted with respect to the wrapper. A suitable applicator gun is that sold by HHS Leimauftrags-Systems GmbH (Krefeld) and described in any one of German Utility Model Nos. DE 20214886, DE 20202381, DE 29508916, German Patent Nos. DE 19936670, DE 19720982, or an applicator gun such as described in U.S. Pat. No. 5,915,625. Advantageously the applicator means comprises a coating head and a flowable medium supply means. Preferably the applicator gun includes actuator means operable to cause intermittent supply of flowable medium. A suitable flowable medium supply means is a KFE-KP9-PMDR-FS glue delivery unit, for example.

The applicator means may be a ribbon applicator, i.e. a contact applicator, or a pattern applicator, i.e. a non-contact applicator.

The supply means of the applicator means advantageously comprises a piston pump operable to delivery flowable medium to the applicator head under pressure. The pressure is suitably within the range of 0-35 bar.

The electronic applicator control means preferably also comprises machine timing mark means. Preferably the timing mark is achieved using signal means, which may be a flag or other actuator, mounted at a predetermined location to allow registration of the material application with respect to position along the rod.

Advantageously the flag is mounted on the drive train of the cutting knife used to cut the continuous rod into rod lengths. Advantageously the start sequence for each material application sequence is reset for each unit filter rod length (usually a 6-up or 4-up rod length). This arrangement ensures the minimum amount of drift in position and pitch of material application.

Advantageously further signal means is taken from an encoder mounted on the drive train of the wrapper supply means. This signal is used to control the rate at which the gun fires as the linear speed of the machine changes.

Suitably the electronic applicator control means is programmed with a variety of material application lengths and positions (pitches).

Preferably the electronic applicator control means comprises a microprocessor or other electronic control means programmed to provide a number of application for patch lengths and/or pitches of application lengths. A suitable microprocessor is a C-1100-MOD microprocessor controller. Alternatively the microprocessor can be incorporated in the electronic control system of the rod making machine.

Advantageously the changeover between pitch and/or application length can be achieved on-line while the machine is still running. This achieves great flexibility for the machine operator at reduced down-time and cost.

Preferably the material applicator means provides precise application of material application at speeds of up to 300 m/min (depending on material application size and pattern). Higher speeds (up to 400 m/min or more) are desirable if accuracy and loading level can be maintained.

Advantageously the material application system can be by-passed easily on the rod making machine, thus allowing product to be made with material application, or not, on the same machine.

Advantageously the material applicator means is located on the rod making machine to allow application of material to the under side of a wrapper supplied to the rod making machine. Such a location provides for the most compact arrangement of the material application system. However, the material application system can be arranged to apply the material to the upper side of the wrapper. As used herein "under side" means that side which would normally be above the material applicator means, as shown in FIG. 1, hereof. Although either side of a wrapper can be treated it is most likely that the treated side will be folded to become an internal surface of a rod produced by the rod making machine. Such may not, of course, be necessary if the rod is to be overwrapped with a further wrapper.

Preferably the material application system is not a roller application system, although one or more rollers may be used in the present invention.

Where the material application system is used in the off-line embodiment, preferably the material application is controlled by means of the pre-programmed material application patterns stored in the electronic applicator control means.

Preferably the off-line apparatus is a reel-to-reel apparatus. Alternatively, the off-line apparatus is located in-line with respect to a tobacco industry rod making machine, upstream of the rod making section of said rod making machine.

The present invention provides a method of applying material to a wrapper of a tobacco industry rod, the method comprising supplying wrapper material to the rod making station of a rod making machine, applying a material to the wrapper using a material applicator and an electronic applicator control means therefor, the electronic applicator control means ensuring accurate location of the material application in a variable manner adjustable electronically by the electronic applicator control means.

The present invention further provides a method of applying material to a wrapper of the tobacco industry, the method comprising supplying wrapper material from a first wrapper supply means to a wrapper storage means, applying a material to the wrapper using a material applicator and electronic applicator control means therefor, the electronic applicator control means ensuring accurate location of material application in a variable manner adjustable electronically by the electronic applicator control means.

Advantageously the pitch and dimension of the material application are adjusted electronically, without the need for alteration of the material applicator. The adjustments may be in accordance with pre-programmed application patterns stored in the electronic applicator control means.

In addition, the speed of additional particulate material application may also be electronically controlled. The process of the invention therefore provides minimal interaction of the operator with machinery parts.

When the material application system is to be used to provide additional material to the wrapper of a continuous rod, the flowable medium supplied to the coating head of the applicator means may also comprises that additional material. That additional material may be flavourant, encapsulated or otherwise, e.g. particulate or granular material provided in an adhesive flowable medium.

Alternatively, the flowable medium is not glue, just an alternative medium that will dry or set on the wrapper, for example, a liquid or semi-liquid, such as a hot melt, viscous material, flavourant material.

Preferably the material application system is used to provide additional particulate material to be adhered to or otherwise contacted with the wrapper supplied by the wrapper supply means. There is then preferably provided an application chamber. The application chamber is supplied with particulate material, suitably via particulate material inlet means. One or more particulate material outlet means may also be provided. Located within the application chamber is a rotatable impeller. Preferably the impeller comprises a shaft with arms provided there around, such as a rotary fan or rotatable paddle, or wheel. The arms of the impeller supply particulate material to the wrapper.

The particulate material to be supplied using this system may be absorbent or adsorbent granular material, such as carbon (activated or not), zeolites, molecular sieves, powdered flavourant, resins, dust (tobacco, for example) or other particulate material for whatever purpose.

Advantageously the impeller is driven by a motor controlled by motor control means. Preferably the motor driving the impeller is connected to the encoder mounted on the drive train of the wrapper drive roller. This allows the speed of the motor and hence the fan to be adjusted with respect to the speed of the rod making machine.

In accordance with the second aspect of the invention, preferably the method is an off-line method, which method allows the wrapper material to be treated with material, then re-reeled onto the wrapper storage means, such as a bobbin.

In either aspect a particle collection tray may also be provided for collection of excess particulate material once the wrapper leaves the confines of the application chamber.

A dust extraction hood may also be provided.

Heaters to ensure drying of an adhesive before the wrapper reaches the rod making section may also be provided.

Preferably the material application system comprises a compact application means and control means which can be fitted within the space available on the front of a current rod making machine of the tobacco industry.

A suitable filter machine is the KDF2 filter maker. The space available below the garniture section (rod making section) thereof is approximately 0.15 $m^2$ or less.

Advantageously the applicator gun is of an area of 0.02 $m^2$ or less. The application chamber is advantageously 0.05 $m^2$ or less. With the presence of a particle collection tray the maximum area is 0.04 $m^2$ or less.

Figure 2:
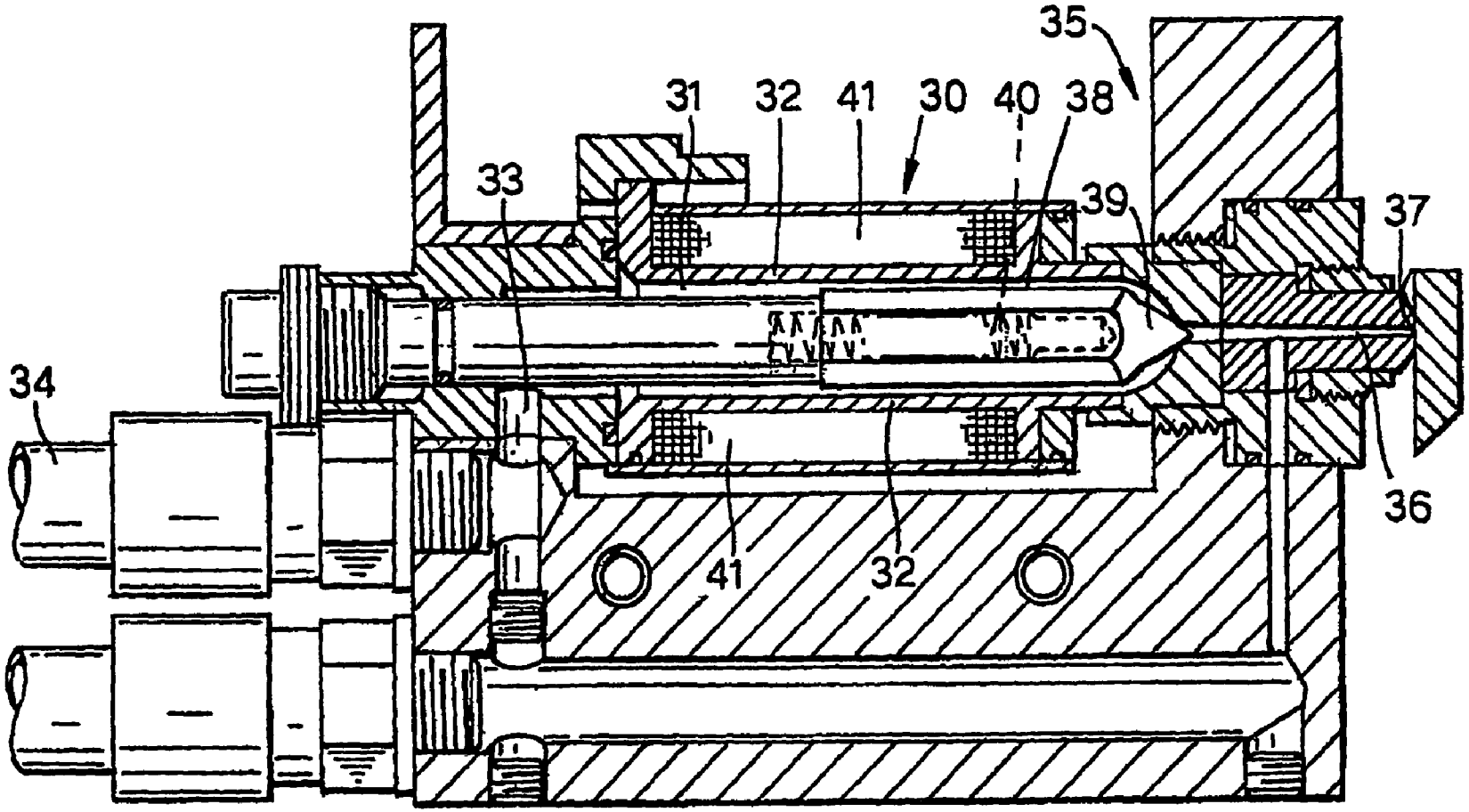

In order that the invention may be easily understood and readily carried into effect, reference will now be made to the diagrammatic drawings hereof, in which:

FIG. 1 shows part of a filter rod making machine 1 according to the invention viewed from the front of the machine, and FIG. 2 shows a material applicator suitable for the invention.

FIG. 1 depicts part of a filter rod making machine 1 according to the invention viewed from the front of the machine. A garniture bed 2 supports a filter tow gathering cone 3 into which is fed a bloomed tow 4 of filtration material and a wrapper, in this case a plugwrap 5. This forms a rod making section. The plugwrap 5 is supplied from a bobbin 6 through a series of rollers 7 to an upper surface of an application chamber 8 of a material application system 9. The upper surface 10 of the application chamber 8 is hingedly attached to allow the upper surface to lift up so that the plugwrap 5 can be passed through the feed path of the application chamber 8. The hinged upper surface 10 can then be closed to seal the application chamber 8. Mounted on an adjustable bracket 11 is material applicator means, in this case an applicator gun 12 whose nozzle is in contact with the plugwrap 5, thereby providing a ribbon of flowable medium to the plugwrap. The applicator gun 12 is fed with flowable medium, in this case adhesive, from flowable medium supply means 13. The applicator gun 12 is attached to applicator adjustment means 14, which is a micrometer adjuster which can adjust the spacing of the applicator gun with respect to the plugwrap. The pressure of contact of the nozzle of the applicator gun 12 is also adjustable by the micrometer adjuster. The adjustable bracket 11 also allows the applicator gun to be positioned laterally (i.e. into and out of the plane of the paper) with respect to the wrapper. Thus the material application can be at any position across the width of the wrapper. Further adjustment means, such as a ratchet, may be provided to allow adjustment of glue quantity.

Suitable material applicator means, such as that described in U.S. Pat. No. 5,915,625, may have the main features shown in FIG. 2. A nozzle housing 30 forms a nozzle chamber 31 in its interior, which chamber is surrounded by a nozzle sleeve 32. A glue channel 33, which in this case is directed transverse axially, i.e. arranged downstream of the nozzle chamber 31. The glue channel 33 is connected to a glue reservoir or a glue pump (see reference numeral 13 of FIG. 1) by means of a line 34. A nozzle head 35 incorporates a nozzle duct 36 extending from the nozzle chamber 31 to a nozzle orifice 37. The nozzle orifice may be operable to supply a continuous i.e. ribbon, strip of glue (or other material) by means of continuous contact with the wrapper during application, or an intermittent (point) application achieved with no contact with the wrapper during application, but by spraying glue or other material onto the wrapper. Interruption of the glue application (whether contact or non-contact) is achieved by closure member 38 mounted within the nozzle chamber 31 so as to be displaceable in the longitudinal direction. The end of the closure member 38 facing the nozzle duct 36 is configured to have a converging cross-section, in this case a cone-shaped closure head 39. The closed position is shown in FIG. 2. For opening and closing the nozzle duct 36 closure member 38 in conjunction with spring 40 can be moved to and fro in the longitudinal direction with a small displacement to provide actuating means. The movements of closure member 38 are effected electromagnetically. For this purpose the nozzle housing 30 is provided with an electric coil 41.

This particular embodiment supplies particulate material, in this case carbon, from within the application chamber 8 to the plugwrap 5. Carbon is supplied through particulate matter inlet 15. A particulate matter outlet 16 is provided, which can be an overflow outlet. Located behind the plate providing the carbon outlet 16 is a rotary impeller 17 comprising arms attached to a drive shaft 18. Drive shaft 18 is connected to drive means 19 (not shown), such as a servo motor. A particulate matter reclaim outlet 20 is located towards a downstream end of application chamber 8. Also provided is a dust extraction outlet 21. Application chamber 8 is divided (but not necessarily completely, as shown) into two sections, primary chamber 22 and secondary chamber 23. Outlet 20 and outlet 21 recover particulate matter from chambers 22 and 23 respectively. Air jets 24 may also be provided to assist in excess particulate material. The air jets may also be useful to balance the air pressure in the chamber so that the wrapper runs smoothly through the chamber. A dust extraction hood 25 and a particulate matter waste tray 26 may also be provided, either alone or in combination. Hence, these items are shown in the figure as chain link lines.

In operation, the application chamber 8 is charged with a supply of particulate material as the machine supplies plugwrap thereto. The speed of the drive means 19 of the rotary impeller 17 is driven in conjunction with the rod making machine speed, in this embodiment being linked by an encoder (not shown) mounted on the drive train of the wrapper drive roller (also not shown). Registration of the material application zone, or patch, to the cut length of rod required is achieved by the use of signal means, or a "flag", mounted on the drive train of a cutting head 27 downstream of the rod making section of the rod making machine. The electronic applicator control means comprises a micro-processor programmed to contain a series of application (or patch) patterns, as required. Each patch pattern is reset for each length of filter rod; for a 108 mm filter rod length four 27 mm filter lengths can be provided, for example. Thus, every time a cut is made the flag generates a signal and a new sequence of adhesive application patterns is initiated. The position of the patch to the cut is called the "offset" and this offset can thus be adjusted electronically for different patch applications, in accordance with the pre-programmed application patterns. There is, thus no need for manual adjustment of printing heads or rollers to accommodate different patch patterns.

As glue is applied to the underside of the plugwrap 5 the freshly glued patch travels only a short distance before entering the first chamber of the application chamber. The underside of the plugwrap 5 is then bombarded by high velocity carbon granules accelerated by the rotary impeller, fan 17. The relationship between the impeller speed and the machine speed can be adjusted using the electronic control system.

In addition, as well as applying carbon to the glued area of plugwrap 5 the fan 17 may also act as a self regulating feeder, i.e. the faster the machine runs, the faster the fan turns and the faster carbon is drawn in from the particulate matter inlet 15. Surplus carbon in the primary chamber 22 spills into secondary chamber 23 and through particulate matter reclaim outlet 20. Also shown in FIG. 1 by dashed lines is the alternative arrangement of plugwrap supply around rollers 27, 28 and 29. This arrangement allows the material application system to be easily by-passed so that non-treated plugwrap can be supplied to the rod making section.

A suitable dust extraction system is the DCE Unimaster supplied by Dust Control Equipment Ltd. Alternatively, a combined feeding and re-circulation system can be used.

The electronic applicator means is beneficial not only in the ease of running the machine and the low cost benefits associated with a retrofit system, but also with a lower deterioration of the glue as there is no "working" of the glue on rotating rollers, which breaks down the glue due to extreme pressure as it is forced between the rollers.

Additional features that can be used with the system include automated feeding of particulate material to the application chamber, for example "high/low" reservoir technology, or loss in weight or screw feeders. Particulate material recovery may also include a recycling step to the particulate feeder to maximise usage of the particulate material.

Material applicator means are also provided that have automated nozzle recovery means to prevent the flowable medium setting within the nozzle (see for example U.S. Pat. No. 5,915,625).

Modifications to the particulate material application system can also be envisaged by the skilled man, such as, for example, a combined impeller and fluidised bed system, in order to maximise the density of particulate matter application to the wrapper. Direct pneumatic spraying of particulate material can also be envisaged.

When the invention is an off-line system, the apparatus therefor usually comprises a first wrapper supply means; such as a bobbin supplying plugwrap; wrapper storage means; such as a bobbin re-reeler; material applicator means being the applicator gun described above, for example, and electronic material applicator means, also as described above.

The invention claimed is:

1. A rod making machine comprising:

rod making means in which wrapping material is applied to a rod;

adhesive applicator means for applying patches of adhesive in predetermined patch positions to the underside of the wrapping material as it passes through the rod making machine prior to application of the underside of the wrapping material to the rod; and an application chamber for receiving the wrapping material to which the adhesive is applied and containing means for applying particulate material to the adhesive on said underside of the wrapping material;

said adhesive applicator means is arranged for applying the patches of adhesive to the material without the use of rollers; and electronic control means arranged to provide a) speed control, controlling the adhesive applicator means and the particulate material applying means in dependence on the speed of the wrapping material measured prior to application of the wrapping material to the rod to ensure that the amount or density of particles that adhere to the adhesive is consistent with a predetermined or required particle application amount or density, and b) position control, controlling the operation of the adhesive applicator means in dependence on operation of the rod making means.

2. A machine according to claim 1, wherein the rod making section includes means for cutting rod in to sections, and signalling means for registration of the position of application of adhesive to the wrapping material with operation of the cutting means.

3. A machine according to claim 2, wherein the cutting means comprises a cutting head and the signalling means is mounted on the cutting head.

4. A machine according to claim 1, where the control means is operable to provide adjustment of the position of application of the adhesive relative to the position at which the cutting head cuts the rod.

5. A machine according to claim 1; wherein the machine comprises a drive train for driving a wrapper supply means, and the electronic control means comprises an encoder mounted on the drive train for producing a signal in dependence on which the operation of the adhesive applicator is controlled as speed of the wrapping material changes.

6. A machine according to claim 1, wherein the particulate applying means comprises a rotary impeller the speed of which is controlled by the electronic control means in dependence upon the speed of the wrapping material.

7. A machine according to claim 1, wherein the electronic control means is arranged to control both patch position and patch length.

8. A machine according to claim 1 where the electronic control means is arranged to control the pitches of the patches.

9. A machine according to claim 1, wherein the electronic control means is programmed with a variety of patch lengths and positions.

10. A rod making machine according to claim 9, wherein said electronic control means comprises a microprocessor or other electronic means programmed to provide a a plurality of different patch lengths and/or pitches.

11. A machine according to claim 1 where the adhesive applicator is operable to contact the wrapping material.

12. A machine according to claim 1 wherein the adhesive applicator is operable to apply adhesive without contacting the wrapping material.

13. A machine according to claim 1, where the adhesive applicator is an applicator gun.

14. A machine according to claim 1, wherein the adhesive applicator is adjustably mounted with respect to the path of the wrapping material through the machine.

15. A machine according to claim 1, wherein the adhesive applicator is a ribbon applicator.

16. A machine according claim 1 wherein the adhesive applicator is a pattern application.

17. A machine according to claim 6 when dependent thereon, wherein the said chamber has an inlet for receiving the particulate material.

18. A machine according to claim 17, wherein an automated feeder is in communication with said particulate material inlet means and is operable to supply said particulate material to said particulate material inlet means.

19. A machine according to claim 17, wherein a particulate material recovery means is in communication with said automated feeder and is operable to supply said automated feeder with recovered particulate material.

20. A machine according to claim 17 comprising a particulate material receiving means in communication with a particulate material reclaim outlet of the said chamber.

21. A machine according to claim 17 further comprising a dust extraction hood.

22. A machine according to claim 1 comprising a heater for drying adhesive applied to the wrapping material.

23. A machine according to claim 1 wherein the adhesive applicator and the application chamber form a unit fitted within the space available on a face of the said machine.

24. A machine according to claim 1 which is a rod making machine of the tobacco industry.

25. A machine according to claim 24 for wrapping rod with rod wrapping material of the tobacco industry.

26. An offline wrapper material processing system comprising:

wrapping material supply means;

adhesive applicator means for applying patches of adhesive in predetermined patch positions to the underside of the wrapping material as it passes through the processing system prior to application of the underside of the wrapping material to a rod; and an application chamber for receiving the wrapping material to which the adhesive is applied and containing means for applying particulate material to the adhesive on said underside of the wrapping material;

the said adhesive applicator means is arranged for applying the patches of adhesive to the material without the use of rollers; and electronic control means arranged to provide a) speed control, controlling the adhesive applicator means and the particulate material applying means in dependence on the speed of the wrapping material measured prior to application of the wrapping material to a rod to ensure that the amount or density of particles that adhere to the adhesive is consistent with a predetermined or required particle application amount or density, and b) position control, controlling the position of application of the adhesive; and means for storing wrapping material to which adhesive and particulate material has been applied.

27. A system according to claim 26; wherein the system comprises a drive train for driving the supply means, and the electronic control means comprises an encoder mounted on the drive train for producing a signal in dependence on which the operation of the adhesive applicator means is controlled as speed of the wrapping material changes.

28. A system according to claim 26, wherein the particulate applying means comprises a rotary impeller the speed of which is controlled by the electronic control means in dependence upon the speed of the wrapping material.

29. A system according to claim 26, wherein the electronic control means is arranged to control both patch position and patch length.

30. A system according to claim 26, where the electronic control means is arranged to control the pitches of the patches.

31. A system according to claim 26, wherein the electronic control means is programmed with a variety of material application lengths and positions.

32. A system according to claim 31, wherein said electronic control means comprises a microprocessor or other electronic means programmed to provide a plurality of different patch lengths and/or pitches.

33. A system according to claim 26, where the adhesive applicator means is operable to contact the wrapping material.

34. A system according to claim 26, wherein the adhesive applicator means is operable to apply adhesive without contacting the wrapping material.

35. A system according to claim 26 where the adhesive applicator means is an application gun.

36. A system according to claim 26, wherein the adhesive applicator means is adjustably mounted with respect to the path of the wrapping material through the system.

37. A system according to claim 26, wherein the adhesive applicator means is a ribbon applicator.

38. A system according to claim 26, wherein the adhesive applicator means is a pattern applicator.

39. A system according to claim 28 when dependent thereon, wherein the said chamber has an inlet for receiving the particulate material.

40. A system according to claim 39, wherein an automated feeder is in communication with said particulate material inlet means and is operable to supply said particulate material to said particulate material inlet means.

41. A system according to claim 40, wherein a particulate material recovery means is in communication with said automated feeder and is operable to supply said automated feeder with recovered particulate material.

42. A system according to claim 39, comprising a particulate material receiving means in communication with a particulate material reclaim outlet of the said chamber.

43. A system according to claim 39 further comprising a dust extraction hood.

44. A system according to claim 26, comprising a heater for drying adhesive applied to the wrapping material.

45. A system according to claim 26, wherein the adhesive applicator means and the application chamber form a unit fitted with the space available on a face of the said system.

46. A system according to claim 26 which is for processing wrapping material used to wrap rods of the tobacco industry.

47. A method of making rods in which wrapping material is applied to rods in a rod making section, the method comprising the steps of:

applying patches of adhesive in predetermined patch positions to the underside of the wrapping material as it passes through the rod making section prior to application of the underside of the wrapping material to the rod; and receiving the wrapping material to which the adhesive is applied and applying particulate material to the adhesive on said underside of the wrapping material;

the said adhesive is applied to the material without the use of rollers; and a) using speed control means, controlling the adhesive application and the particulate material application in dependence on the speed of the wrapping material measured prior to application of the wrapping material to the rod to ensure that the amount or density of particles that adhere to the adhesive is consistent with a predetermined or required particle application amount or density, and b) using position control means, controlling the operation of the adhesive application in dependence on operation of the rod making section.

48. A method of processing wrapping material comprising the steps of:

supplying wrapping material;

applying patches of adhesive in predetermined patch positions to the underside of the wrapping material prior to application of the underside of the wrapping material to a rod; and receiving the wrapping material to which the adhesive is applied and applying particulate material to the adhesive on said underside of the wrapping material; wherein the patches of adhesive are applied to the material without the use of rollers; and a) using speed control means, controlling the adhesive application and the particulate material application in dependence on the speed of the wrapping material measured prior to application of the wrapping material to a rod to ensure that the amount or density of particles that adhere to the adhesive is consistent with a predetermined or required particle application amount or density, and b) using position control means, controlling the position of application of the adhesive to the underside of the wrapping material; and storing wrapping material to which adhesive and particulate material has been applied.

49. The method of claim 47 wherein the wrapping material is wrapping material used in making rods of the tobacco industry.

* * * * *